United States Patent [19]

Gidge et al.

[11] 4,392,360

[45] Jul. 12, 1983

[54] STRIP CURTAIN FOR DISPLAY TYPE REFRIGERATORS

[75] Inventors: Kenneth N. Gidge; Henry J. Richard, both of Nashua, N.H.

[73] Assignee: BSL Corporation, Nashua, N.H.

[21] Appl. No.: 305,462

[22] Filed: Sep. 25, 1981

[51] Int. Cl.[3] ..... A47F 3/04

[52] U.S. Cl. ..... 62/249; 62/256; 62/265; 160/332; 312/116

[58] Field of Search ..... 62/256, 255, 265, 249; 24/306; 160/328, 332; 312/116

[56] References Cited

U.S. PATENT DOCUMENTS

| | | | |
|---|---|---|---|
| 2,041,258 | 5/1936 | Mitchell | 62/265 X |
| 3,235,926 | 2/1966 | Mates | 24/306 |
| 4,109,484 | 8/1978 | Cunningham | 62/256 |
| 4,288,992 | 9/1981 | Eliason | 62/256 |
| 4,296,792 | 10/1981 | Gidge et al. | 312/116 X |
| 4,312,396 | 1/1982 | McKinnon et al. | 160/332 |

*Primary Examiner*—Lloyd L. King

[57] ABSTRACT

A curtain comprised of a plurality of individual separable strips is provided for use across the front or top of a display type refrigerator such as used in supermarkets or the like. A sufficient number of strips are attached along the upper edge of the cabinet opening to span the width of the opening, each strip being of a length sufficient to span the length of the opening. Each strip detachably connects to the cabinet and is also detachably connected to one another whereby one or more strips may be removed from the cabinet and attached piggy back fashion to one or several strips for loading and unloading the refrigerator.

7 Claims, 6 Drawing Figures

STRIP CURTAIN FOR DISPLAY TYPE REFRIGERATORS

BACKGROUND OF THE INVENTION

1. Field of the Invention

This invention relates generally to curtains for use on display type refrigerators and more particularly is directed towards a new and improved strip type curtain comprised of a plurality of individually detachable curtain strips.

2. Description of the Prior Art

In copending application Ser. No. 9,049, filed Feb. 5, 1979, now U.S. Pat. No. 4,296,792, and Ser. No. 93,193, filed Nov. 13, 1979, now U.S. Pat. No. 4,313,485, there are disclosed access curtains for use on open front and open top refrigerators of the sort used in supermarkets by means of which refrigerated goods can be displayed to the customer in an accessible manner without significant loss of cold air from the refrigerator to the surrounding area. These curtains are comprised of a single sheet of transparent flexible plastic material formed with a plurality of vertical slits therein. Curtains of this type work extremely well in retaining refrigerated air within the cabinet while permitting goods to be readily removed by the customer. These curtains generally have been provided in certain specified widths corresponding to the width of the opening in the refrigerator. However, some store operators for certain types of refrigerator units prefer a strip type curtain. However, the strip type curtains heretofore available have not proven to be particularly satisfactory especially with respect to the disposition of the strips when loading the refrigerator with fresh produce.

Accordingly, it is an object of the present invention to provide improvements in strip type curtains for use across the open front of a display type refrigerator.

Another object of this invention is to provide a strip type curtain for a refrigerator unit in which individual strips may be quickly and easily mounted in place or detached therefrom as required and may be connected to one another in superimposed relation for temporarily opening the unit.

SUMMARY OF THE INVENTION

This invention features a strip type curtain for use across the open front of a display type refrigerator, the curtain being comprised of a plurality of individual narrow strips, each of a flexible transparent plastic material of a length sufficient to extend from top to bottom of the refrigerator opening. Across the edge of the cabinet opening is installed a strip of fastening material such as one part of a Velcro fastener while at the top of each strip is a section of the other part of the fastener material so that each strip may be pressed into position and hung over the door opening or peeled away therefrom. Also, at the top of each strip on the opposite side thereof there is another section of the fastener material whereby individual strips may be attached to one another in superimposed relation for temporary storage to permit opening of the curtain for restocking the refrigerator.

DETAILED DESCRIPTION OF THE PREFERRED EMBODIMENT

Figure 1:
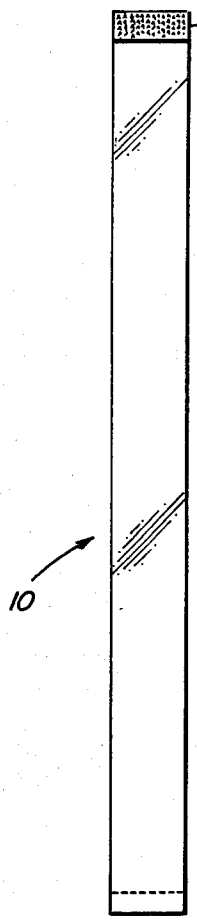
FIG. 1 is a view in front elevation of an individual curtain strip made according to the invention.
Figure 2:
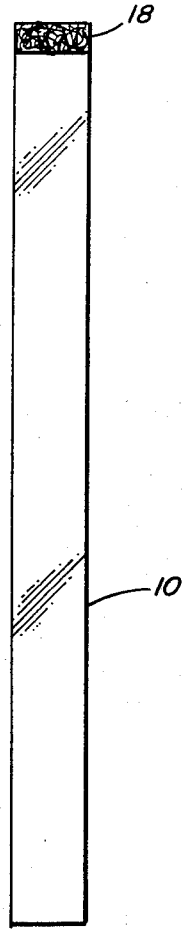
FIG. 2 is a view in rear elevation thereof.
Figure 3:
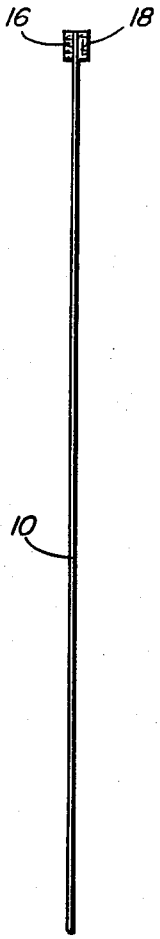
FIG. 3 is a view in side elevation thereof.

Referring now to the drawings, the reference character 10 generally indicates an individual curtain strip which when used with a number of similar strips assembled in side-by-side relation forms a curtain for use in providing a thermal barrier for an open front display refrigerator 12. Each strip 10 preferably is fabricated from a relatively soft, flexible, transparent plastic materials such as vinyl, polyethylene, clear PVC or other suitable plastic ranging in thickness perhaps from about 6 mils up to 50 gauge, for example, which will stand up under long use without cracking or scratching when subjected to hard wear and cold temperatures. Each strip is rectangular in outline and may be made up in various lengths and widths, a typical width may be on the order of 4–6" with a length of perhaps 4–5' depending upon the height of the cabinet opening over which the strips will be installed. The strips should be long enough to run from top to bottom of the opening with at least some overhang below the lower edge of the opeing as suggested in the drawings. The dimensions of the strips are not critical and may be increased or decreased. The strips should be of a sufficient weight so that they will hang relatively flat and straight so that when side-by-side the edges of one strip will be in substantially butting relationship to the edge on the adjacent strip. To this end a weight 14 can be added to the lower edge of each strip. The weight may take the form of a short section of metal bar, rod or some other weighting materials mounted in a sleeve of poscket formed at the bottom of each strip. For example, a rubber weight may be bonded by an adhesive to the vinyl or a plastic weight (rigid or flexible) may be heat sealed to the vinyl. Also the lower edge may be folded back upon itself to form a relatively thick hem of plastic held together by heat sealing or the like.

At the top of each strip is flexible fasteners 16 and 18 of the sort sold under the Trademark VELCRO which consists of a male and female member. The male member is comprised of a number of flexible hooks while the female member is comprised of a felt material. Two parts are locked together by pressing one against the other and can be separated by peeling one away from the other. In the illustrated embodiment the male fastener 16 is bonded to the outer face of each strip while the female member 18 is bonded to the inner opposite face of the strips.

Figure 5:
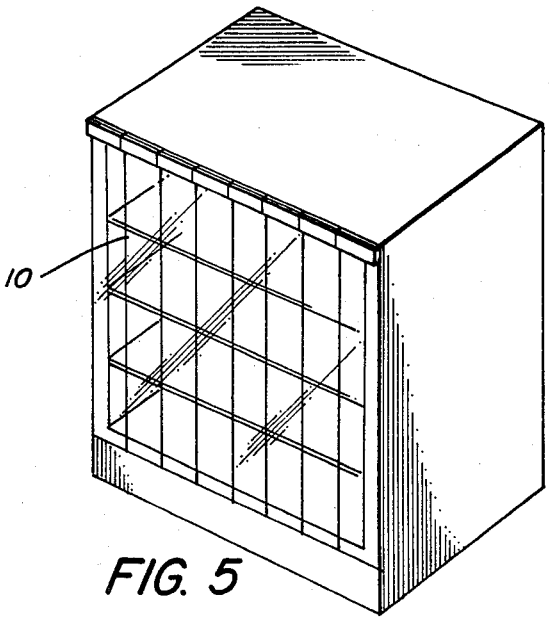
FIG. 5 is a view similar to FIG. 4 but showing the curtain in an open position, and, FIG. 6 is a fragmentary side elevation of the curtain and cabinet of FIG. 5.

Each fastener 16 and 18 preferably extends the full width of each strip. The height of each fastener should be sufficient to provide adequate locking area between the fasteners and in practice, a height of perhaps an inch or two is sufficient for most purposes. Along the upper edge of the cabinet 12 just above the opening there is applied a long section 20 of one part of a flexible fastener such as Velcro and preferably the male part thereof. The section 20 extends the full width of the opening with some overlap at the sides and is adapted to hold a plurality of strips 10 fastened therealong in the manner suggested in FIG. 5 so that the refrigerator opening may be fully covered by strips 10.

The strips are applied by merely pressing the female fastener 18 of each strip against the male fastener section 20 on the cabinet, each strip 10 being located immediately adjacent another strip until the opening is entirely spanned. When all of the strips are in place a very effective thermal barrier is provided to contain most of the refrigerated air within the cabinet 12 thereby greatly reducing the energy requirements needed to maintain the proper refrigeration level for food stored in the cabinet. Since the strips are transparent customers may view the contents of the refrigerator without opening the curtain. In the event that a customer decides to purchase one or more items within the refrigerator 12, he or she merely slips his or her hand between a pair of strips, grasps the item and removes it from the case. The strips will return to their original straight hanging position preventing the escape of refrigerated air.

Figure 4:
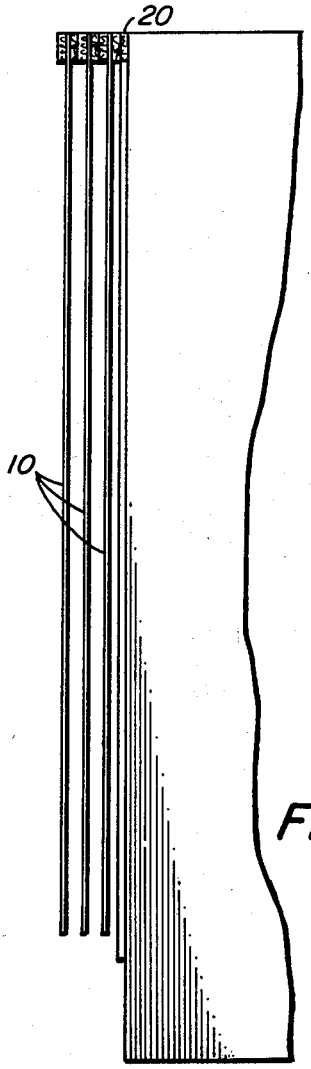
FIG. 4 is a view in perspective showing a full strip curtain made according to the invention and installed on a typical display type refrigerator.
Figure 6:
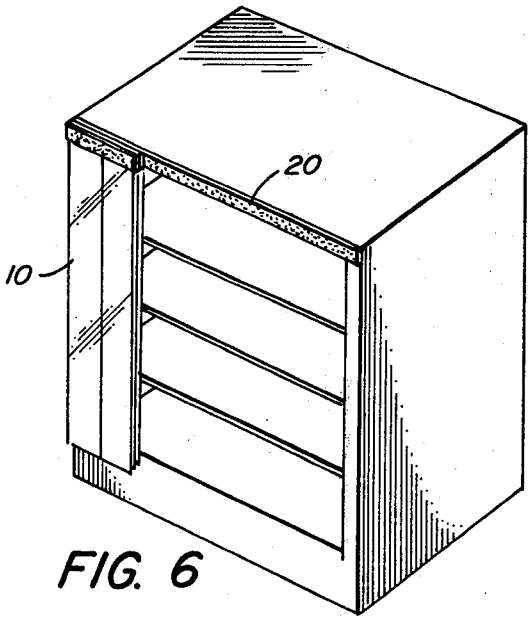

Since each refrigerator must be restocked periodically the curtain may be conveniently opened to allow for restocking by merely peeling away a number of strips 10 and pressing one on top of the other in piggy back fashion as suggested in FIGS. 4 and 6. Thus, all of the strips on the right hand side of the refrigerator may be peeled away and pressed against one or several strips on the left hand side of the cabinet. Since each strip has both a male and a female fastener at the top thereof, they can be conveniently pressed one against the other in a piggy back manner on a temporary basis. Once the refrigerator has been restocked, the strips are removed from their temporary storage position and refastened against the section 20 to again form a full curtain as in FIG. 5.

While the invention has been described with particular reference to the illustrated embodiment, numerous modifications thereto will appear to those skilled in the art.

Having thus described the invention, what we claim and desire to obtain by Letters Patent of the United States is:

1. A closure for disposition across the opening of a display refrigerator, comprising:

a plurality of strips extending over said opening;

first fastening means attached to at least certain of the strips on a given surface thereof for mounting the strips in proximity to the opening;

second fastening means attached to the refrigerator in proximity to an edge of the opening for reciprocally mating with and engaging the first fastening means on at least certain of the strips to releasably mount at least certain of the strips directly to the refrigerator in a substantially sidewise adjacent relationship to at least partially cover the opening; and third fastening means attached to at least certain of the strips on a second given surface different from said first given surface for reciprocally mating with and engaging said first fastening means of an adjacent strip to releasably mount said strips together in a substantially superimposed stacked relationship to at least temporarily uncover at least a portion of the opening, thereby to allow at least certain of the strips to be attached to outer faces of certain other strips to facilitate loading and unloading of the refrigerator while maintaining the strips in locations convenient to the opening for rapid assembly and disassembly of the closure.

2. The closure of claim 1 wherein the strips are flexible and substantially rectangular in conformation, wherein the first fastening means is attached to an inner face of each strip along an upper edge thereof, the area of attachment comprising the first given surface, and wherein the third fastening means is disposed on an outer face of at least certain of the strips along an upper edge thereof, the area of attachment comprising the second given surface, the first and third fastening means being thus respectively attached to at least certain of the strips on opposite faces thereof.

3. The closure of claim 2 wherein the first fastening means comprise one portion of a hook-and-loop fastener and the second and third fastening means comprise the other portion of the hook-and-loop fastener, the first fastening means on a given strip thus releasably engaging either the second fastening means on the refrigerator or the third fastening means on an outer face of another strip, thereby to allow releasable attachment of the strips together in superimposed stacked relation with an innermost strip being releasably attached to the second fastening means on the refrigerator.

4. The closure of claim 2 wherein the strips are transparent.

5. The closure of claim 1 and further comprising a weight carried by at least certain of the strips to maintain the strips in covering relation with the opening.

6. The closure of claim 5 wherein a weight is disposed on either of the strips.

7. A method for rapid assembly and disassembly of a closure over the opening of a display refrigerator to allow convenient loading and unloading of the contents of the refrigerator, the closure being comprised of a plurality of elongated strips having a first fastener on an inner face of each of the strips and a second mating fastener on an outer face of at least certain of the strips, the refrigerator having a third fastener disposed adjacent to the opening, which third fastener mates with said first fastener, comprising the steps of:

engaging the first fasteners on the strips to the third fastener on the refrigerator to attach the strips in a sidewise adjacent relationship to cover the opening;

disengaging the first fastener of at least certain of the strips from the third fastener on the refrigerator and removing the disengaged strip from a covering position relative to the opening; and engaging the first fastener of said disengaged strip to the second fastener of another strip which remains attached to the third fastener on the refrigerator or which is attached to the second fastener of another strip in a stack of strips releasably mounted to the refrigerator, thereby to form or continue building a superimposed stack of strips which stores the strips in a convenient location relative to the opening for rapid reassembly of the strips over the opening.

* * * * *